US007479932B2

(12) United States Patent
Tanaka et al.

(10) Patent No.: US 7,479,932 B2
(45) Date of Patent: Jan. 20, 2009

(54) DISPLAY DEVICE, DRIVE METHOD THEREOF, AND DRIVE SYSTEM THEREOF

(75) Inventors: Noriyuki Tanaka, Kawasaki (JP); Kouji Kumada, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 596 days.

(21) Appl. No.: 11/058,272

(22) Filed: Feb. 16, 2005

(65) Prior Publication Data

US 2005/0179640 A1 Aug. 18, 2005

(30) Foreign Application Priority Data

Feb. 17, 2004 (JP) ..... 2004-040494

(51) Int. Cl.
*G09G 5/00* (2006.01)

(52) U.S. Cl. ..... 345/1.1; 345/204

(58) Field of Classification Search ..... 345/1.1–3.3, 345/204–215

See application file for complete search history.

(56) References Cited

U.S. PATENT DOCUMENTS

| | | | | |
|---|---|---|---|---|
| 7,184,012 | B1 | 2/2007 | Kim | |
| 2003/0063041 | A1 | 4/2003 | Kurashima et al. | |
| 2003/0112204 | A1 * | 6/2003 | Pettersen | 345/1.1 |
| 2003/0210215 | A1 | 11/2003 | Takahashi | |
| 2004/0021616 | A1 * | 2/2004 | Goto et al. | 345/1.1 |
| 2004/0027315 | A1 | 2/2004 | Senda et al. | |
| 2004/0140947 | A1 * | 7/2004 | Tsuyuki et al. | 345/1.1 |
| 2004/0246428 | A1 | 12/2004 | Shirato | |
| 2005/0174299 | A1 * | 8/2005 | Park et al. | 345/1.1 |
| 2005/0253773 | A1 | 11/2005 | Sekiguchi | |

FOREIGN PATENT DOCUMENTS

| | | | |
|---|---|---|---|
| GB | 2332294 | A | 6/1999 |
| JP | 08-248913 | A | 9/1996 |
| JP | 11-282003 | A | 10/1999 |
| JP | 2000-275611 | A | 10/2000 |
| JP | 2001-67049 | A | 3/2001 |
| JP | 2001-255513 | A | 9/2001 |
| JP | 2001-265278 | A | 9/2001 |
| JP | 2001-282145 | A | 10/2001 |
| JP | 2002-357845 | A | 12/2002 |
| JP | 2003-131250 | A | 5/2003 |
| JP | 2003-177685 | A | 6/2003 |
| JP | 2003-323164 | A | 11/2003 |
| WO | WO 2004/029918 | A1 | 4/2004 |

* cited by examiner

*Primary Examiner*—Alexander Eisen
*Assistant Examiner*—Cory A Almeida
(74) *Attorney, Agent, or Firm*—Harness, Dickey & Pierce, P.L.C.

(57) ABSTRACT

The sub panel 100, having a plurality of gate bus lines 14, source bus lines 16, TFTs 25 and pixel electrodes, is provided with a source driver 15. The main panel 200 has a plurality of gate bus lines 24, source bus lines 16, TFTs 25 and pixel electrodes, each of the source bus lines 16 being connected to the corresponding source bus lines 16 of the first liquid crystal panel 10 through a switching TFT 17. The main panel 200, sharing the source driver 15 with the first liquid crystal panel 10, is less frequently used for display than the first liquid crystal panel 10, and is disconnected by the switching TFT 17 when only the sub panel 100 is used. This makes it possible to device a twin-panel display device low in electric power consumption.

12 Claims, 10 Drawing Sheets

DISPLAY DEVICE, DRIVE METHOD THEREOF, AND DRIVE SYSTEM THEREOF

This Nonprovisional application claims priority under 35 U.S.C. § 119(a) on Patent Application No. 040494/2004 filed in Japan on Feb. 17, 2004, the entire contents of which are hereby incorporated by reference.

FIELD OF THE INVENTION

The present invention relates to a display device of a liquid crystal display apparatus and the like including a plurality of active matrix display panels. The present invention also relates to a drive method of the display device.

BACKGROUND OF THE INVENTION

Recently, a so-called twin panel formed of two display panels has been heavily used in a portable device etc., particularly in a foldable mobile phone. FIG. 11 is a circuit diagram showing a twin panel 581 as an example of such a twin panel. The twin panel 581 is formed of a main panel 582 and a sub panel 583.

The main panel 582 includes a TFT substrate 584, which has a substrate and a thin film transistor (TFT) 592 provided thereon; a counter substrate 585, which faces the TFT substrate 584; and a liquid crystal layer (LC) 594, which serves as a display medium sandwiched between the TFT substrate 584 and the counter substrate 585.

Provided on the TFT substrate 584 are a plurality of gate bus lines 588 and a plurality of source bus lines 589. Disposed near a crossing of each gate bus line 588 and each source bus line 589 is a TFT 592. A gate of the TFT 592 is connected to the gate bus line 588. A source of the TFT 592 is connected to the source bus line 589. The drain of the TFT 592 is connected to a pixel electrode. Then, between the pixel electrode and the counter electrode (COM) 593 provided on the counter substrate 585, a voltage is applied to the LC 594 serving as a pixel. All of the TFTs 592 are respectively supplied with voltages, so that an image is displayed.

Further, the main panel 582 also has a gate driver 590 and a source driver 591. An outgoing line extending from the gate driver 590 is connected to the gate bus line 588, and an outgoing line extending from the source driver 591 is connected to the source bus line 589. Then, the gate driver 590 and the source driver 591 apply a gate signal voltage and a display data signal to the respective bus lines.

Meanwhile, the sub panel 583 includes a TFT substrate 586, which has a substrate and a thin film transistor 592 provided thereon; a counter substrate 587, which faces the TFT substrate 586; and liquid crystal layer (LC) 594, which serves as a display medium sandwiched between the TFT substrate 586 and the counter substrate 587.

The sub panel 583 is connected to the main panel 582 through a flexible printed circuit (FPC; not shown). This allows a gate signal voltage or a display data signal to be applied from the gate driver 590 and the source driver 591 of the main panel 582 through the wiring in the main panel 582 and the FPC to each bus line of the sub panel 583.

Provided on the TFT substrate 586 are a plurality of gate bus lines 588 and a plurality of source bus lines 589. Disposed near a crossing of each gate bus line 588 and each source bus line 589 is a TFT 592. A gate of the TFT 592 is connected to the gate bus line 588. A source of the TFT 592 is connected to the source bus line 589. A drain of the TFT 592 is connected to a pixel electrode. Then, between the pixel electrode and the counter electrode (COM) 593 provided on the counter substrate 587, a voltage is applied to the LC 594 serving as a pixel. All of the TFTs 592 are respectively supplied with voltages so that an image is displayed. This makes it possible to display an image on the main panel 582 or the sub panel 583.

Examples of such a device having a twin panel can be found in Tokukai 2001-067049 (Prior Art 1; published on Mar. 16, 2001), Tokukai 2001-282145 (Prior Art 2; published on Oct. 12, 2001), and Tokukai 2003-131250 (Prior Art 3; published on May 8, 2003).

Prior Art 1 discloses a foldable mobile communication terminal apparatus having a twin panel formed of a first liquid crystal display section (first liquid crystal display device) and a second liquid crystal display section (second liquid crystal display device). The mobile communication terminal apparatus has a body section, and a cover section (folder cover section) that is foldable/unfoldable relative to the body section. The first liquid crystal display section is provided on an inner surface of the cover section (inner surface in a folded state). The second liquid crystal display section is provided on an outer surface of the cover section (outer surface in a folded state). The first and the second liquid crystal display sections are driven by one driver, which is provided on the side of the first liquid crystal display section. That is, an output from the driver is input into the second liquid crystal display section through the first liquid crystal display section. The second liquid crystal display section has a smaller display area than the first liquid crystal display section (see FIGS. 4 and 5 in Patent Document 1). The second liquid crystal display section displays time and general information while the first liquid crystal display section displays various kinds of information. Only the second liquid crystal display section makes a display with the cover section closed, and only the first liquid crystal display section makes a display with the cover section opened.

As with Prior Art 1, Prior Art 2 discloses a foldable mobile phone with a twin panel formed of a first liquid crystal display section (inner liquid crystal display section) and a second liquid crystal display section (outer liquid crystal display section). The mobile phone has a body section (lower housing) and a cover section (upper housing) foldable/unfoldable relative to the body section. The first liquid crystal display section is provided on an inner surface of the cover section (inner surface in a folded state). The second liquid crystal display section is provided on an outer surface of the cover section (outer surface in a folded state). The first and the second liquid crystal display sections are driven by one driver, which is provided on the side of the first liquid crystal display section. That is, an output from the driver is input into the second liquid crystal display section through the first liquid crystal display section. The second liquid crystal display section has a smaller display area than the first liquid crystal display section (see FIGS. 3 and 4 in Patent Document 2). Only the second liquid crystal display section makes a display with the cover section closed, and only the first liquid crystal display section makes a display with the cover section opened.

As with Prior Art 1, Prior Art 3 discloses a foldable mobile phone with a twin panel formed of a first liquid crystal display section (LCD) and a second liquid crystal display section (LCD). The mobile phone has a body section and a cover section (lid) foldable/unfoldable relative to the body section. The first liquid crystal display section is provided on an inner surface of the cover section (inner surface in a folded state). The second liquid crystal display section is provided on an outer surface of the cover section (outer surface in a folded state). The first and the second liquid crystal display sections are driven by one driver, which is provided on the side of the first liquid crystal display section. That is, an output from the driver is input into the second liquid crystal display section through the first liquid crystal display section. The second liquid crystal display section has a smaller display area than the first liquid crystal display section (see FIGS. 1 and 10 in Patent Document 3). The second liquid crystal display section displays basic information such as a received call and date; the first liquid crystal display section displays main information.

One of the major demands for the twin-panel display device, which, as described above, is heavily used in a portable device such as a mobile phone, is reduction in power consumption. However, measures for reducing power consumption attempted in the conventional devices have not yet achieved sufficient power reduction.

SUMMARY OF THE INVENTION

It is an object of the present invention to provide a liquid crystal display device capable of sufficiently reducing electric power consumption, and a drive method of the liquid crystal display device.

In order to achieve the above object, a display device of the present invention includes: a first display section (first display means), which includes a plurality of gate signal lines; a plurality of source signal lines; first switching sections, each of which is disposed near each of crossings of the gate signal lines and the source signal lines with a control terminal for switching operation connected to the gate signal line; pixel electrodes, each of which is connected to the source signal line through the first switching section, the first display section further including a source-signal-line drive circuit for supplying a display data signal to each of the plurality of source signal lines; a second switching section; and a second display section (second display means) which includes the plurality of gate signal lines; the plurality of source signal lines; the first switching sections; and the pixel electrodes, each of the source signal lines being connected to a corresponding one of the source signal lines of the first display section through the second switching section, the second display section sharing the source-signal-line drive circuit with the first display section, the second display section being used for display less frequently than the first display section.

Further, a drive method of the display device of the present invention uses the display device including: a first display section which includes a plurality of gate signal lines; a plurality of source signal lines; the first switching sections, each of which is disposed near each of crossings of the gate signal lines and the source signal lines with a control terminal for switching operation connected to the gate signal line; and pixel electrodes connected to the source signal line through the first switching section, and a second display section which includes the plurality of gate signal lines; the plurality of source signal lines; the first switching sections; and pixel electrodes, the method including the steps of: supplying a display data signal to the source signal line of the second display section through the source signal line of the first display section; conducting corresponding ones of the source signal lines of the first display section and the source signal lines of the second display section when the second display section performs display operation; and disconnecting the corresponding ones of the source signal lines of the first display section from the source signal lines of the second display section when the first display section performs display operation and the second display section stops display operation, wherein: the second display section is used for display less frequently than the first display section.

According to the above arrangement, the second display section can be disconnected from the first display section when the first display section performs display operation and the second display section stops display operation. This reduces an electrical load generated by the second display section being connected, thereby lowering electric power consumption.

Further, a display data signal is supplied to the source signal lines of the second display section less frequently used for display through the source signal lines of the first display section more frequently used for display. Therefore, when the display device is in use, the source signal lines of the second display section are connected for a shorter period of time than those of the first display section, thereby helping lower electric power consumption.

In order to achieve the above object, a drive system of the present invention is a drive system for driving a plurality of source signal lines provided in a first display section, and a larger number of source signal lines, provided in a second display section, wherein: the source signal lines of the first display section and the source signal lines of the second display section are connected through a switch section provided therebetween, and the source signal lines of the second display section are driven by a source-signal-line drive circuit, provided in the first display section, which drives the source signal lines of the first display section.

Since the first display section of the drive system has a smaller number of source lines (for example lower resolution) and lower in electric power consumption than the second display section, the first display section is used as a display section more frequently driven.

Accordingly, in the present invention, the first display section that is more frequently driven (e.g., a low-resolution display section) is provided with a source-signal-line drive circuit for driving the source line of the first display section and a switch section for connecting the source signal lines of the first and the second display section (e.g., the switch section is used to drive in a time-sharing manner the plurality of source signal lines, corresponding to each source signal line of the first display section, of the second display section), so that the source-signal-line drive circuit of the first display section is also used as a circuit for driving the second display section (e.g., the high-resolution display section).

Therefore, the arrangement of the present invention achieves low electric power consumption as compared with an arrangement in which a drive circuit provided in a high-resolution display section less frequently driven drives a source line of a low-resolution display section more frequently driven.

For a fuller understanding of the nature and advantages of the invention, reference should be made to the ensuing detailed description taken in conjunction with the accompanying drawings.

BRIEF DESCRIPTION OF THE DRAWINGS

FIG. 2(*b*) is a perspective view showing a folded state, where the cover section is opened, of the same mobile phone.

DESCRIPTION OF THE EMBODIMENTS

First Embodiment

One embodiment of the present invention will be described below based on the accompanying drawings.

Figure 1:
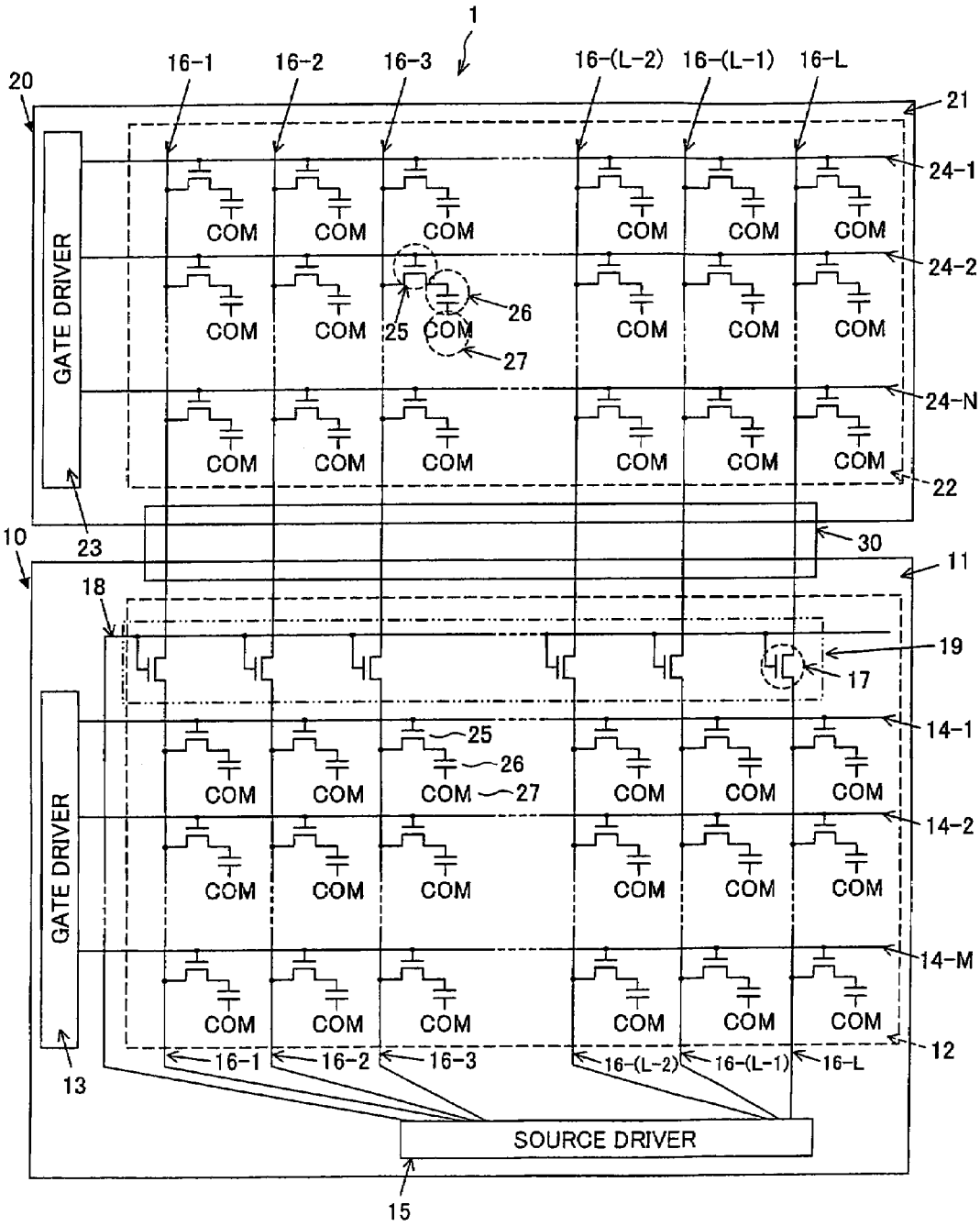
FIG. 1 is a circuit diagram showing an arrangement of a display device according to one embodiment of the present invention.

FIG. 1 is a circuit diagram showing a liquid crystal display device (display device) 1 of the present embodiment. As shown in FIG. 1, the liquid crystal display device 1 is a twin-panel display device which has a first liquid crystal panel (first display means) 10 and a second liquid crystal panel (second display means) 20.

The first liquid crystal panel 10 includes a TFT substrate 11, which is provided with a thin film transistor (TFT) 25; a counter substrate 12, which faces the TFT substrate 11; and a liquid crystal layer, which serves as a display medium sandwiched between the TFT substrate 11 and the counter substrate 12. The liquid crystal layer constitutes a liquid crystal capacitor 26.

Provided on the TFT substrate 11 are a plurality of gate bus lines (gate signal lines) 14 and a plurality of source bus lines (source signal lines) 16. Provided near a crossing of each gate bus line 14 and each source bus line 16 is the TFT (first switching means) 25. A gate of the TFT 25 is connected to the gate bus line 14. A source of the TFT 25 is connected to the source bus line 16. A drain of the TFT 25 is connected to a pixel electrode. Then, a voltage is applied to the liquid crystal capacitors 26, which constitutes a pixel between a counter electrode (COM) 27, provided on the counter substrate 12, and the pixel electrode. All of the TFTs 25 are respectively supplied with voltages so that an image is displayed.

The second liquid crystal panel 20 includes a TFT substrate 21, which is provided with the TFT 25; a counter substrate 22, which faces the TFT substrate 21; and a liquid crystal layer, which serves as a display medium sandwiched between the TFT substrate 21 and the counter substrate 22. The liquid crystal layer constitutes the liquid crystal capacitor 26.

Provided on the TFT substrate 21 are a plurality of gate bus lines 24 and a plurality of source bus lines 16. Provided near a crossing of each gate bus line 14 and each source bus line 16 is a TFT 25. A gate of the TFT 25 is connected to the gate bus line 24. A source of the TFT 25 is connected to the source bus line 16. A drain of the TFT 25 is connected to a pixel electrode. Then, a voltage is applied to the liquid crystal capacitor 26, which constitutes a pixel between the counter electrode (COM) 27, provided on the counter substrate 22, and the pixel electrode. All of the TFTs 25 are respectively supplied with voltages so that an image is displayed.

It is to be noted, in FIG. 1, that symbols such as -L, -M, and -N, appended to the reference numerals of the source bus line 16 and of the gate bus lines 14 and 24, represent the line reference number of each line, and symbols such as L, M, and N represent the total number of each line. Note that, in the following description, when the line does not have one of the symbols such as -L, -M, and -N it is an unspecific line.

In the liquid crystal display device 1 of the present embodiment, each source bus line 16 of the first liquid crystal panel 10 corresponds individually to one of the source bus line 16 of the second liquid crystal panel 20. Therefore, a source bus lines 16 of the gate bus line 14 and the corresponding source bus line 16 of the gate bus line 24 can be conducted through a switch section 19 and for example an flexible printed circuit (FPC) 30 serving as a flexible connection member. The switch section 19 is provided in the first liquid crystal panel 10. The FPC 30 is provided between the first liquid crystal panel 10 and the second liquid crystal panel 20. The switch section 19 does not always have to be provided on the first liquid crystal panel 10 but may be provided on the second liquid crystal panel 20; otherwise, the switch section 19 may be provided between the first liquid crystal panel 10 and the second liquid crystal panel 20.

The switch section 19 has a switching TFT (second switching means) 17 and a switching control signal line 18. The switching TFT 17 is provided for each source bus line 16 so as to connect/disconnect the source bus line 16 of the first liquid crystal panel 10 and the source bus line 16 of the second liquid crystal panel 20. The switching control signal line 18, formed in the direction of the gate bus line 14, transmits to a gate of each switching TFT 17 a switching control signal for turning on and off the switching TFT 17. The switching control signal is supplied from a source driver (source-signal-line drive circuit) 15 to the switching control signal line 18.

In the first liquid crystal panel 10 and the second liquid crystal panel 20, the gate bus lines 14 and 24 are provided with and driven by gate drivers 13 and 23 respectively. The source bus line 16 is provided with and driven by the source driver 15 for common use in the first liquid crystal panel 10 and the second liquid crystal panel 20. The gate drivers 13 and 23 output a gate signal (gate selection signal) to the gate bus lines 14 and 28. The source driver 15 outputs a display data signal to the source bus line 16. The source driver 15 is provided on the side of the first liquid crystal panel 10. The display data signal supplied to the second liquid crystal panel 20 is supplied via the first liquid crystal panel 10.

When the liquid crystal display device 1 is provided in one apparatus, the first liquid crystal panel 10 is more frequently used for display (for a longer period of time) than the second liquid crystal panel 20. For example, in an apparatus, the first liquid crystal panel 10 is used as a display device for indicating time, a current status of the apparatus, or some kind of general information. The second liquid crystal panel 20 is used for example as a display device for starting display operation according to commands by a user and displaying more detailed information (some kind of detailed information) than the first liquid crystal panel 10.

Figure 2:
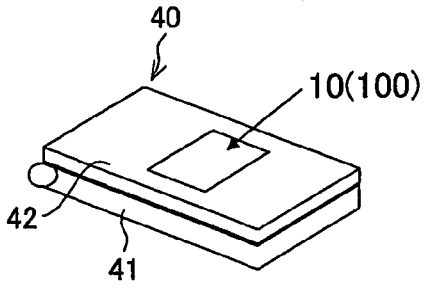
FIG. 2(*a*) is a perspective view showing a folded state, where a cover section is closed, of a mobile phone having the display device shown in FIG. 1.
Figure 2:
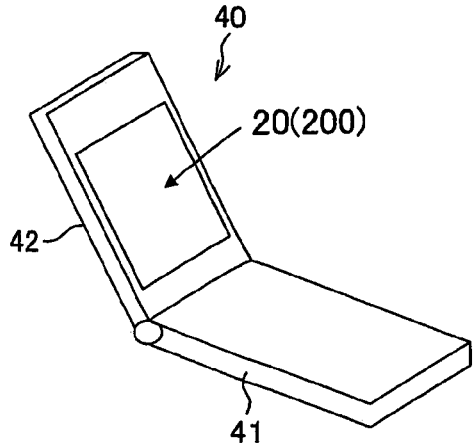
Figure 3:
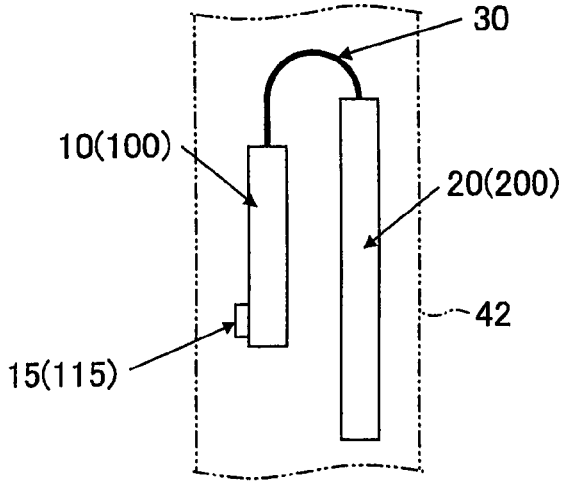
FIG. 3 is a longitudinal sectional view showing a main portion of the cover section of the mobile phone shown in FIG. 2.

For example, as shown in FIGS. 2(*a*) and 2(*b*), a mobile phone 40, which is constituted of a body section 41 (first housing) and a cover section 42 (second housing) that can be foldable/unfoldable relative to the body section, is arranged so that the first liquid crystal panel 10 is provided on an outer surface of the cover section 42 (outer surface in a folded state), and the second liquid crystal panel 20 is provided on an inner surface of the cover section 42 (inner surface in a folded state). FIG. 3 is a longitudinal sectional view showing a main portion of the cover section 42 in a folded state. As shown in FIG. 3, the first liquid crystal panel 10 and the second liquid crystal panel 20 are provided back to back with each other inside of the cover section 42.

As described above, the liquid crystal display device 1 is arranged so that the source driver 15 is provided on the side of the first liquid crystal panel 10 which is more frequently used for display, and one drive circuit (the source driver 15) drives two display panels (the first liquid crystal panel 10 and the second liquid crystal panel 20), and the switch section 19 disconnects the two display panels (the first liquid crystal panel 10 and the second liquid crystal panel 20).

The mobile phone 40 has its cover section 42 opened when in use for making a call, sending an e-mail, checking a received e-mail, and the like. In this case, display operation of the first liquid crystal panel 10 is turned off, and display operation of the second liquid crystal panel 20 is turned on. Meanwhile, in a waiting state (power on state) where the cover section 42 is closed, display operation of the first liquid crystal panel 10 is turned on, and display operation of the second liquid crystal panel 20 is turned off. Since the mobile phone 40 normally has its cover section 42 closed, more specifically, for example, the cover section 42 is closed for a longer time than opened in a day, the first liquid crystal panel 10 is more frequently used for display than the second liquid crystal panel 20.

When the cover section 42 closed in the liquid crystal display device 1, only the first liquid crystal panel 10 performs display and the second liquid crystal panel 20 is turned off. In this case, a switching control signal supplied from the source driver 15 turns off all the switching TFTs 17 of the switch section 19, so that a display data signal from the source driver 15 is not supplied to the source bus line 16 of the second liquid crystal panel 20. Here, the gate driver 13 is in operation, and the gate driver 23 is stopped.

Furthermore, the source driver 15 outputs a switching control signal in the following manner, for example. The state where the cover section 42 is closed is detected for example by an open-close detecting switch (not shown) serving as an open-close detecting means provided in the mobile phone 40, and the detection signal is input to a control means (not shown). Then, based on a command from the control means, the source driver 15 outputs a switching control signal.

Meanwhile, in the state where the cover section 42 is opened, only the second liquid crystal panel 20 performs display, and the first liquid crystal panel 10 is turned off. In this case, a switching control signal supplied from the source driver 15 turns on all the switching TFTs 17 of the switch section 19, so that a display data signal from the source driver 15 is supplied to the source bus line 16 of the second liquid crystal panel 20. Here, the gate driver 13 is stopped, and the gate driver 23 is in operation.

In the following, display operation of the first liquid crystal panel 10 and the second liquid crystal panel 20 will be described more in detail.

Figure 4:
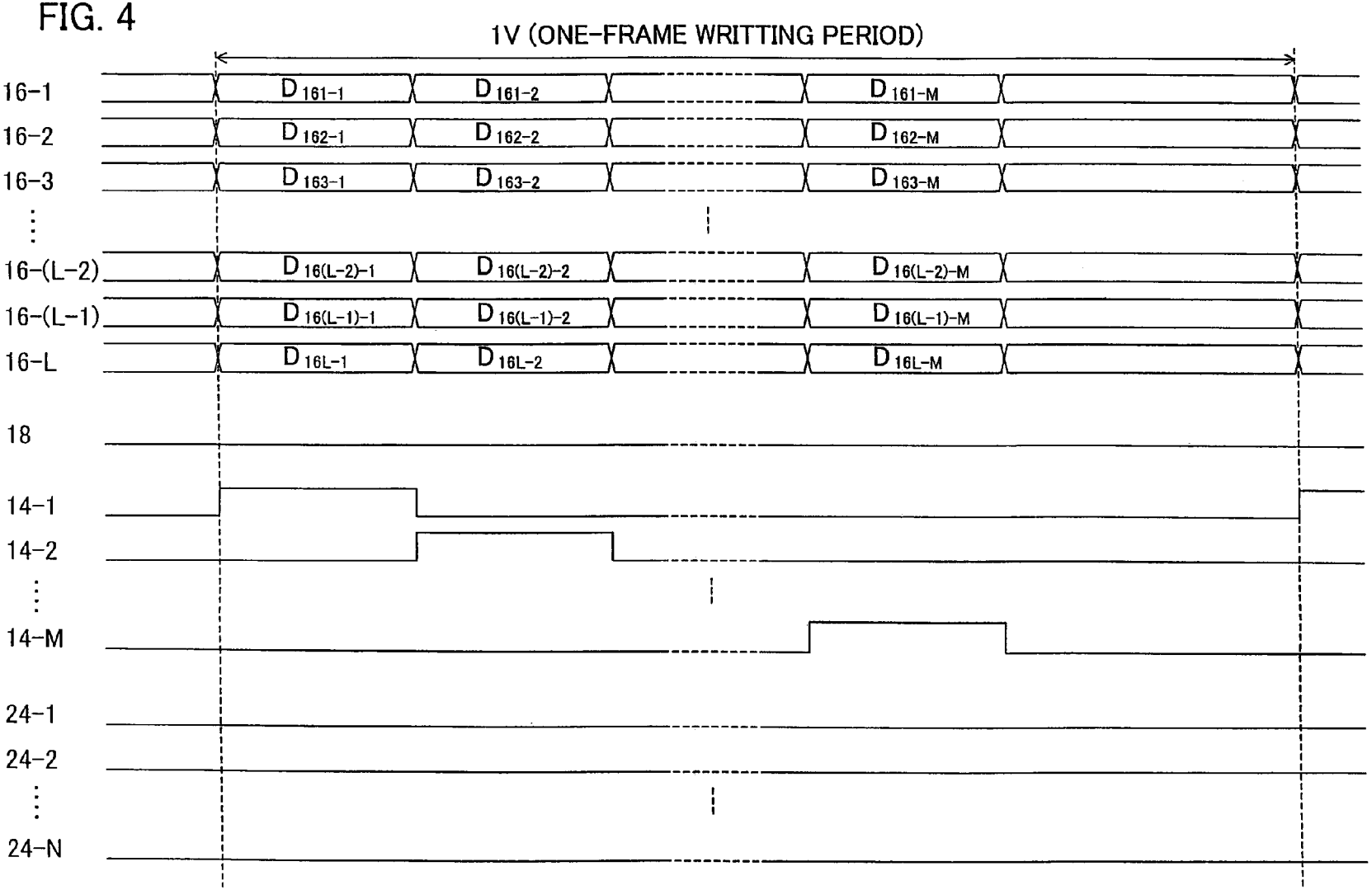
FIG. 4 is a timing chart showing operation which causes a first liquid crystal panel in the display device shown in FIG. 1 to make a display.

When the first liquid crystal panel 10 is caused to perform display, as shown in FIG. 4, the source driver 15 applies a display data signal to the source bus line 16, and the gate driver 13 applies to the gate bus line 14 a gate signal for turning on and off the TFT 25. When a voltage of the gate bus line 14 becomes High, the TFT 25 which is connected to the gate bus line 14 is turned on, so that the display data signal applied to the source bus line 16 is written into the pixel (liquid crystal capacitor 26).

As for display drive (operation) of the first liquid crystal panel 10, a display data signal is applied to the source bus lines 16-1 to 16-L so as to drive the gate bus lines 14-1 to 14-M in a line-sequential manner. In this way, the display (writing) of each frame is repeated.

At this time, since the second liquid crystal panel 20 does not perform display, the source driver 15 applies a Low voltage (switching control signal) to the switching control signal line 18 so as to turn off all the switching TFTs 17 of the switch section 19, so that the source bus lines 16 (16-1 to 16-L) of the second liquid crystal panel 20 are electrically disconnected from the source bus lines 16 (16-1 to 16-L) of the first liquid crystal panel 10. Further, at this time, the gate bus line 24 of the second liquid crystal panel 20 is not driven, either.

In the above operation, in display operation of the first liquid crystal panel 10 which is more frequently used for display, the load of the second liquid crystal panel 20 is electrically disconnected. In this way, power consumption of the liquid crystal display device 1 can be reduced.

Figure 5:
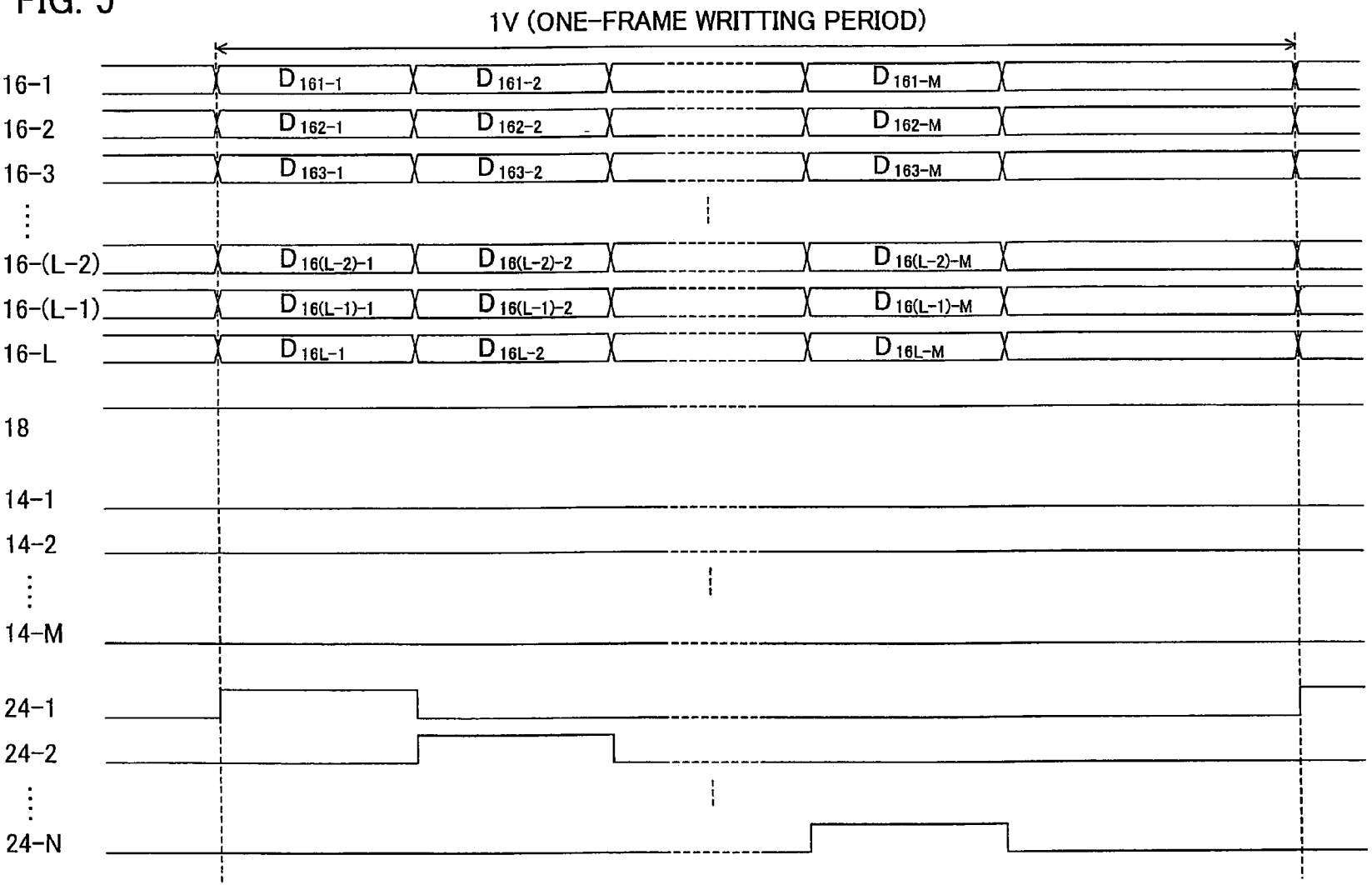
FIG. 5 is a timing chart showing operation which causes a second liquid crystal panel in the display device shown in FIG. 1 to make a display.

Meanwhile, when the second liquid crystal panel 20 is caused to perform display, as shown in FIG. 5, the source driver 15 applies a display data signal to the source bus line 16, and the gate driver 23 applies to the gate bus line 24 a gate signal for turning on and off the TFT 25. When a voltage of the gate bus line 24 becomes High, the TFT 25 which is connected to the gate bus line 24 is turned on, so that the display data signal applied to the source bus lines 16 is written into the pixel (liquid crystal capacitor 26).

As for display drive of the second liquid crystal panel 20, a display data signal is applied to the source bus lines 16-1 to 16-L so as to drive the gate bus lines 24-1 to 24-N in a line-sequential manner. In this way, the display (writing) of each frame is repeated.

At this time, although the first liquid crystal panel 10 does not perform display, the source driver 15 applies a High voltage (switching control signal) to the switching control signal line 18 so as to keep all the switching TFTs 17 of the switch section 19 turned on in order that a display data signal is applied to the second liquid crystal panel 20. However, the gate bus lines 14-1 to 14-M are not driven.

In the above operation, when the second liquid crystal panel 20 performs display, the load of the first liquid crystal panel 10 cannot be electrically disconnected, thereby requiring extra electricity. However, this rarely occurs since the second liquid crystal panel 20 performs display less frequently. Meanwhile, because the second liquid crystal panel 20 is electrically disconnected when the first liquid crystal panel 10, which is more frequently performs display, performs display, the entire power consumption of the liquid crystal display device 1 can be reduced.

Note that, the electrical load is attributable mainly to capacity of an insulation part at a crossing with the gate bus line 14, parasitic capacity at the TFT 25 part, etc.

Further, a configuration of the first liquid crystal panel 10 and the second liquid crystal panel 20 in the mobile phone 40 is not limited to the structures described above. For example, when the mobile phone 40 is assumed as an apparatus whose second housing is foldable/unfoldable relative to the first housing, the liquid crystal panel 10 may be provided with its display surface disposed on an outer surface of the first or the second housing in the folded state where the second housing is folded to the first housing, and the second liquid crystal panel 20 may be provided with its display surface disposed on an inner surface of the first or the second housing in the folded state where the second housing is folded to the first housing. This theory can also be applied to the relationship between a sub panel 100 and a main panel 200 that is described later.

Second Embodiment

Figure 6:
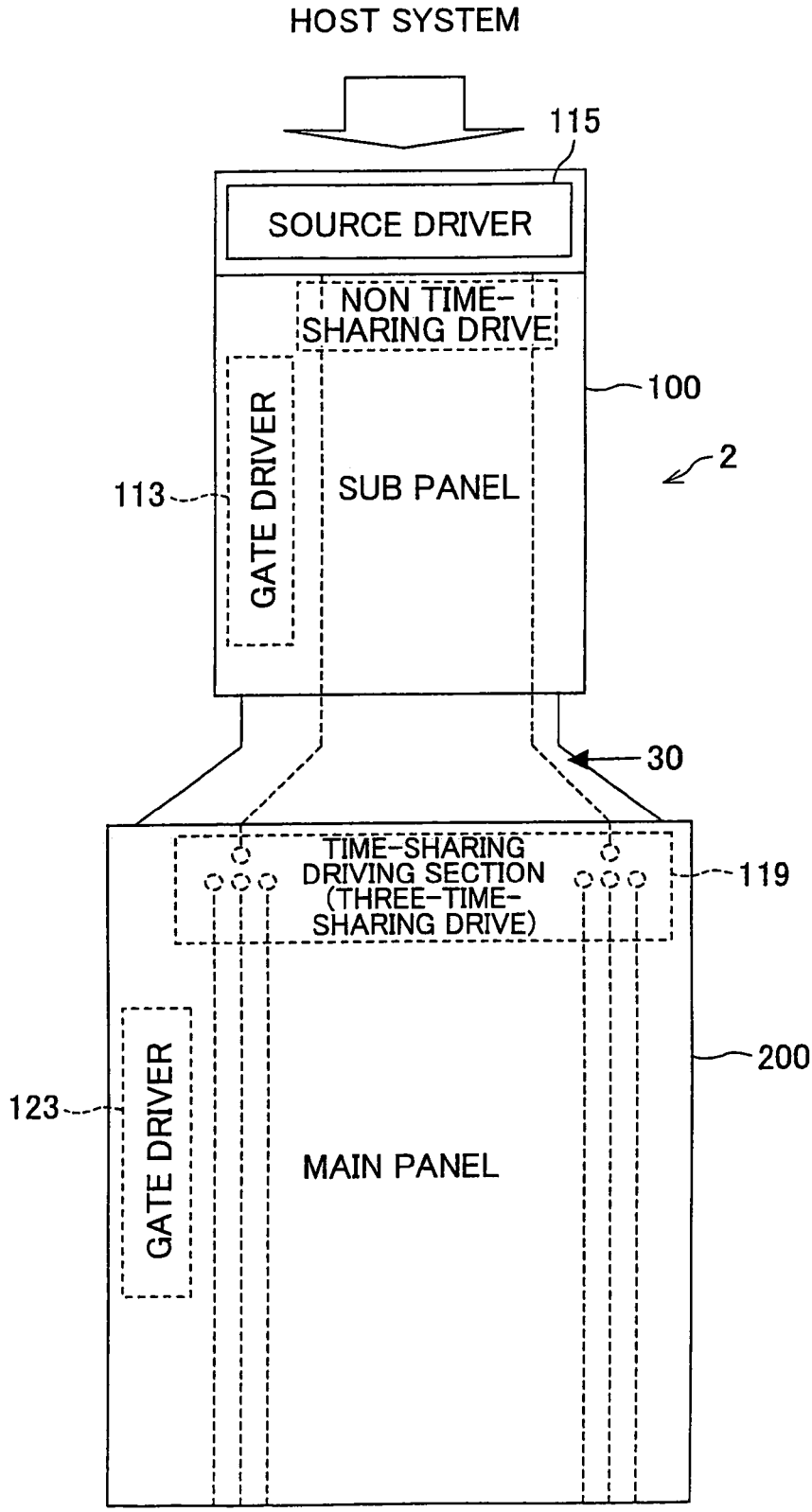
FIG. 6 is a front view showing a schematic arrangement of a display device according to another embodiment of the present, invention.

Another embodiment of the present invention will be described below based on the accompanying drawings. As shown in FIG. 6, a liquid crystal display device (display device) 2 of the present embodiment is a twin-panel display device which is constituted of a sub panel (first display means) 100 and a main panel (second display means) 200. The sub panel 100 and the main panel 200 are active matrix panels. A gate bus line of the sub panel 100 and a gate bus line of the main panel 200 are provided with and driven by gate drivers 113 and 123 respectively. A source bus line of the sub panel 100 and a source bus line of the main panel 200 are provided with and driven by one source driver 115 for common use in the sub panel 100 and the main panel 200.

The source driver 115 outputs a display data signal, which is then supplied to the source bus line of the main panel 200 through the source bus line of the sub panel 100. Furthermore, the source bus line of the sub panel 100 and the source bus line of the main panel 200 are connected for example through an FPC 30 serving as a connection member with a flexible characteristic. The FPC 30 is provided between the panels.

The main panel 200 has a larger number of pixels and higher resolution than the sub panel 100. This means that the main panel 200 has a larger number of source bus lines than the sub panel 100. Therefore, in the liquid crystal display device 2, one source bus line of the sub panel 100 corresponds to a plurality of source bus lines of the main panel 200. More specifically, the liquid crystal display device 2 causes a time-sharing driving section 119 (time-sharing driving means) to supply a display data signal for one source bus line in the sub panel 100 to the plurality (e.g., three in FIG. 6) of source bus lines in the main panel 200. In actual operation, the time-sharing driving section 119 formed of a plurality of changeover switches supplies a display data signal of each source bus line in the sub panel 100 in a time-sharing manner from each of the switches to the plurality of corresponding source bus lines in the main panel 200.

Thus, the sub panel 100 is driven in a normal (non time-sharing) manner by the source driver 115 provided on the side of the sub panel 100 with a smaller number of pixels, and the main panel 200 with a larger number of pixels is driven by in a time-sharing manner, thereby enabling the main panel 200 to perform display with higher resolution than the sub panel 100.

Figure 7:
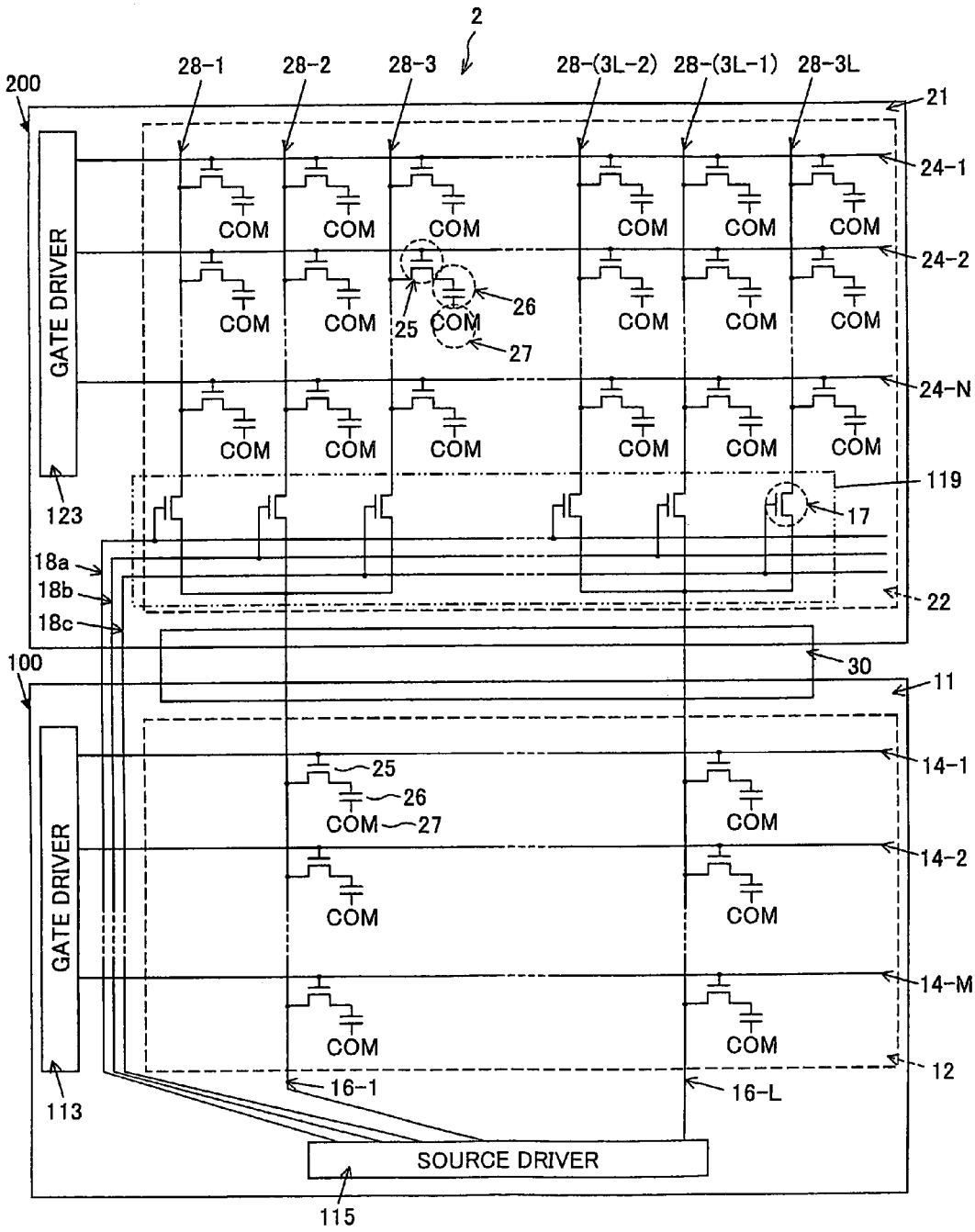
FIG. 7 is a circuit diagram showing an arrangement of the display device shown in FIG. 6.

FIG. 7 is a circuit diagram showing the liquid crystal display device 11 of FIG. 6.

As with the first liquid crystal panel 10, the liquid crystal display device 2 is arranged so that the sub panel 100 has a TFT substrate 11, which is provided with a TFT 25, and a liquid crystal capacitor 26, which is formed of a counter substrate 12 and a liquid crystal layer. Disposed on the TFT substrate 11 are a plurality of gate bus lines 14, a plurality of source bus lines 16, and the TFT 25. The TFT 25 applies a voltage to the liquid crystal capacitor 26, which constitutes a pixel between a counter electrode (COM) 27, provided on the counter substrate 12, and the pixel electrode.

As with the second liquid crystal panel 20, the main panel 200 has a TFT substrate 21, which is provided with the TFT 25, and the liquid crystal capacitor 26, which is formed of a counter substrate 22 and a liquid crystal layer. Disposed on the TFT substrate 21 are a plurality of gate bus lines 24, a plurality of source bus lines 28, and the TFT 25. The TFT 25 applies a voltage to the liquid crystal capacitor 26, which constitutes a pixel between a counter electrode (COM) 27, provided on the counter substrate 22, and the pixel electrode.

In the liquid crystal display device 2 of the present embodiment, the time-sharing driving section 119 is provided in the main-panel 200. The time-sharing driving section 119 includes a switching TFT 17 that is provided in each source bus line 28 of the main panel 200. The switching TFT 17 is provided at the end of the side of the sub panel 100 in the source bus line 28.

The liquid crystal display device 2 is arranged so that a display data signal supplied from one source bus line 16 of the sub panel 100 is sent for example to three source bus lines 28 of the main panel 200 in a time-sharing manner. This means that the three adjacent switching TFTs 17 make up a group, and one source bus line 16 can be conducted through the switching TFTs 17 to the three source bus lines 28 corresponding to the group of three switching TFTs 17.

Further, the time-sharing driving section 119 has first, second, and third switching control signal lines 18*a*, 18*b*, and 18*c*, that correspond to first, second, and third switching TFT 17 in each group, respectively. The first switching control signal line 18*a* is connected to a gate of the first switching TFT 17 in each group. The second switching control signal line 18*b* is connected to a gate of the second switching TFT 17 in each group. The third switching control signal line 18*c* is connected to a gate of the third switching TFT 17 in each group. The first, the second, and the third switching control signal lines 18*a*, 18*b*, and 18*c* are each supplied with a switching control signal for driving in a time-sharing manner the switching TFT 17 in each group, i.e., for connecting in a time-sharing manner the three source bus lines 28 in each group to one corresponding source bus line 16.

Moreover, the time-sharing driving section 119 is capable of disconnecting the sub panel 100 (source bus line 16 of the sub panel 100) from the main panel 200 (source bus line 28 of the main panel 200).

Furthermore, in view of, for example, wiring efficiency, it is preferable that the time-sharing driving section 119 is disposed in the main panel 200; however, the present invention includes both of the arrangement in which the time-sharing driving section 119 is disposed in the sub panel 100, and the arrangement in which the time-sharing driving section 119 is provided between the sub panel 100 and the main panel 200.

In an apparatus, the sub panel 100 is used as a display device for indicating time, a current status of the apparatus, or some kind of general information. The main panel 200 is used as a display device for starting display operation according to commands by a user and displaying more detailed information (some kind of detailed information) than that displayed on the sub panel 100.

For example, as shown in FIGS. 2(*a*) and 2(*b*), a mobile phone 40, which is constituted of a body section 41 and a cover section 42 that can be foldable/unfoldable relative to the body section 41, is arranged so that the sub panel 100 is provided on an outer surface of the cover section 42 (outer surface in a folded state), and the main panel 200 is provided on an inner surface of the cover section 42 (inner surface in a folded state). FIG. 3 is a longitudinal sectional view showing a main portion of the cover section 42 in a folded state. As shown in FIG. 3, the sub panel 100 and the main panel 20 are provided back to back with each other inside of the cover section 42.

As described above, the liquid crystal display device 2 is arranged so that the source driver 115 is provided on the side of the sub panel 100 with low resolution, and one drive circuit (the source driver 115) drives two display panels (the sub panel 100 and the main panel 200), and the time-sharing driving section 119 drives the main panel 200 in a time-sharing manner and disconnects the two display panels (the sub panel 100 and the main panel 200).

The mobile phone 40 has its cover section 42 opened when in use for making a call, sending an e-mail, checking a received e-mail, and the like. In this case, display operation of the sub panel 100 is turned off, and display operation of the main panel 200 is turned on. Meanwhile, in a waiting state (power off state) where the cover section 42 is closed, display operation of the sub panel 100 is turned on, and display operation of the main panel 200 is turned off. Since the mobile phone 40 normally has its cover section 42 closed, more specifically, for example, the cover section is closed for a longer time than opened in a day, the sub panel 100 is more frequently used for display than the main panel 200.

When the cover section 42 is closed in the liquid crystal display device 2, only the sub panel 100 performs display and the main panel 200 is turned off. In this case, a switching control signal supplied from the source driver 115 turns off all the switching TFTs 17 of the time-sharing driving section 119, so that a display data signal from the source driver 115 is not supplied to the source bus line 28 of the main crystal panel 200. Here, the gate driver 113 is in operation, and the gate driver 123 is stopped.

Meanwhile, in the state where the cover section 42 is opened, only the main panel 200 performs display, and the sub panel 100 is turned off. In this case, a switching control signal supplied from the source driver 115 turns on the switching TFTs 17 of the time-sharing driving section 119, so that a display data signal from the source driver 115 is supplied to the source bus line 28 of the main panel 200. Here, the gate driver 113 is stopped, and the gate driver 123 is in operation.

In the following, display operation of the sub panels 100 and the main panel 200 will be described more in detail.

Figure 8:
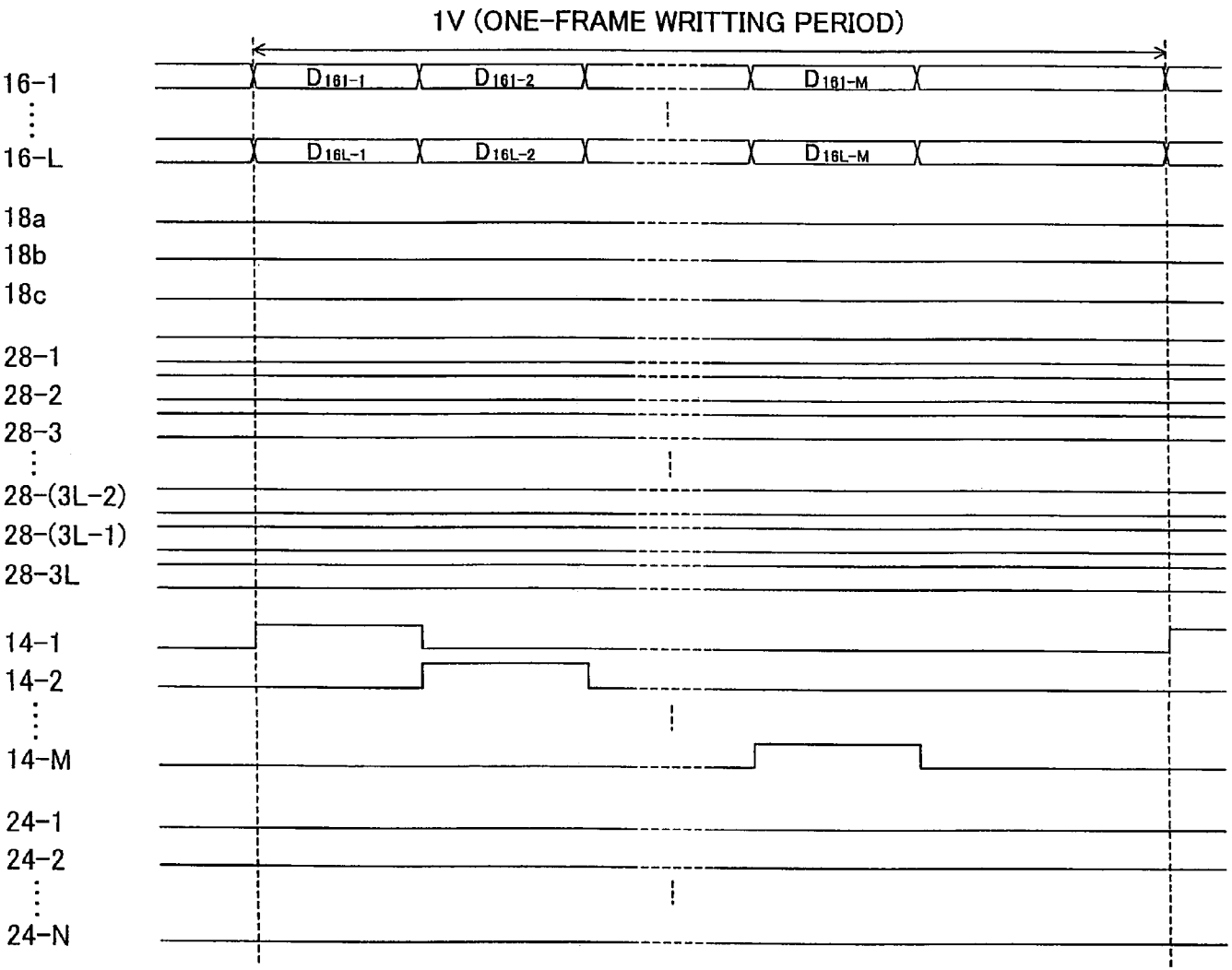
FIG. 8 is a timing chart showing operation which causes a sub panel in the display device shown in FIG. 7 to make a display.

When the sub panel 100 is caused to perform display, as shown in FIG. 8, the source driver 15 applies a display data signal to the source bus line 16, and the gate driver 113 applies to the gate bus line 14 a gate signal for turning on and off the TFT 25. When a voltage of the gate bus line 14 becomes High, the TFT 25 which is connected to the gate bus line 14 is turned on, so that the display data signal applied to the source bus line 16 is written into the pixel (liquid crystal capacitor 26).

As for display drive (operation) of the sub panel 100, a display data signal is applied to the source bus lines 16-1 to 16-L so as to drive the gate bus lines 14-1 to 14-M in a line-sequential manner. In this way, the display (writing) of each frame is repeated.

At this time, since the main panel 200 does not perform display, the source driver 115 applies a Low voltage to the first, second, and third switching control signal lines 18*a*, 18*b*, and 18*c* so as to turn off all the switching TFTs 17 of the time-sharing driving section 119, so that the source bus lines 28-1 to 28-3L of the main panel 200 are electrically disconnected. Further, at this time, the gate bus line 24-1 to 24-N of the main panel 200 is not driven, either.

In the above operation, in display operation of the sub panel 100 with low resolution, the load of the main panel 200 with high resolution is electrically disconnected. In this way, power consumption of the liquid crystal display device 2 can be reduced.

Figure 9:
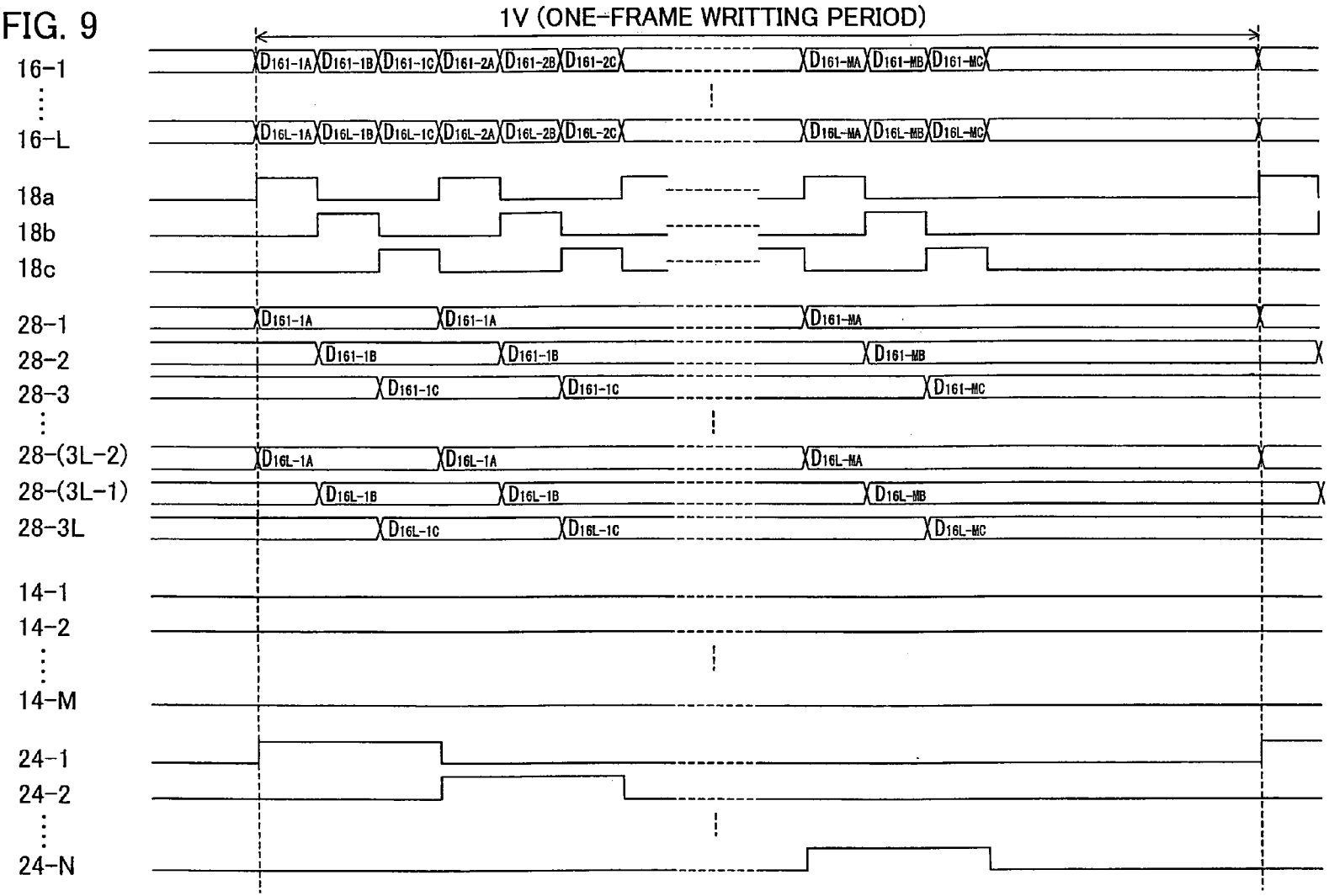
FIG. 9 is a timing chart showing operation which causes a main panel in the display device shown in FIG. 7 to make a display.

Meanwhile, when the main panel 200 is caused to perform display, as shown in FIG. 9, the source driver 115 applies a display data signal to the source bus line 16, and the gate driver 123 applies to the gate bus line 24 a gate signal for turning on and off the TFT 25. When a voltage of the gate bus line 24 becomes High, the TFT 25 which is connected to the gate bus line 24 is turned on, so that the display data signal applied to the source bus lines 16 is written into the pixel (liquid crystal capacitor 26).

Here, in the liquid crystal display device 2, since a display data signal from the source driver 115 is transmitted to the source bus lines 28 of the main panel 200 with high resolution through the source bus lines 16 of the sub panel 100 with low resolution, the main panel 200 with high resolution is driven in a time-sharing manner.

As for display drive of the main panel 200, a display data signal is applied to the source bus lines 16-1 to 16-L so as to drive the gate bus lines 24-1 to 24-N in a line-sequential manner. In this way, the display (writing) of each frame is repeated.

At this time, although the first liquid crystal panel 10 does not perform display, the sub panel 100 controls the on/off switching of the switching TFT 17 of the time-sharing driving section 119 in order to apply a display data signal to the main panel 200. Specifically, s switching control signal from the first, second, and third switching control signal lines 18*a*, 18*b*, and 18*c* controls the on/off switching of the switching TFT 17 connected thereto and sends a display data signal in a time-sharing manner to a set of three source bus lines 28, e.g., to the source bus lines 28-1, 28-2, and 28-3. However, the gate bus lines 14-1 to 14-M are not driven.

In the above operation, when the main panel 200 with high resolution performs display, the load of the sub panel 100 with low resolution cannot be electrically disconnected, thereby requiring extra electricity. However, when the mobile phone 40 so foldably arranged has a twin-panel structure including the main panel 200 with high resolution and the sub panel 100 with low resolution, the sub panel 100 with low resolution is more frequently used for display, and the main panel 200 with low resolution is less frequently used for display. Therefore, with the liquid crystal display device 2 in use, the main panel 200 rarely performs display, so that the entire power consumption of the liquid crystal display device 2 can be reduced.

Note that, the electrical load is attributable mainly to capacity of an insulation part at a crossing with the gate bus line 14, parasitic capacity at the TFT 25 part, etc.

Figure 10:
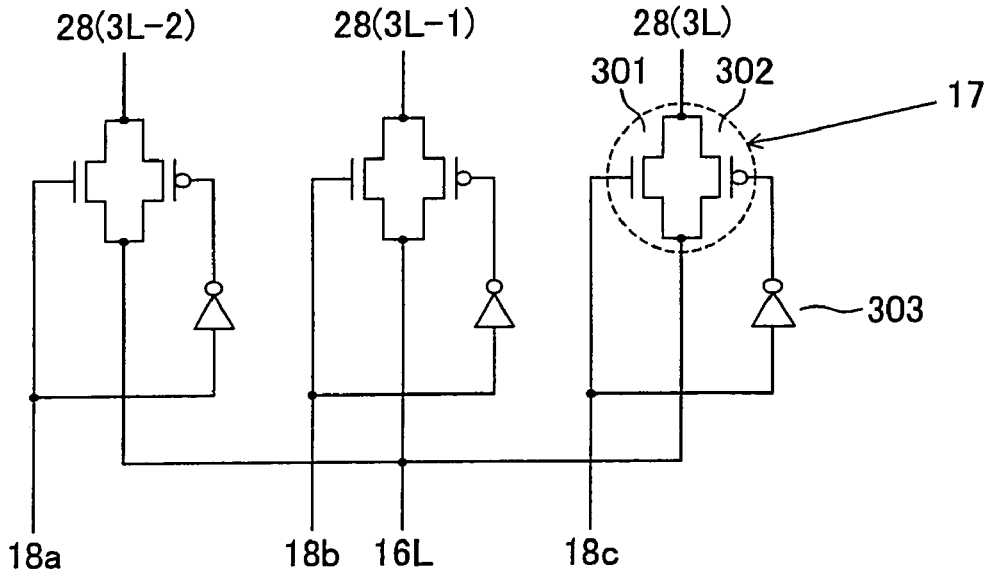
FIG. 10 is a circuit diagram showing an alternative of a switching TFT shown in FIG. 7.
Figure 11:
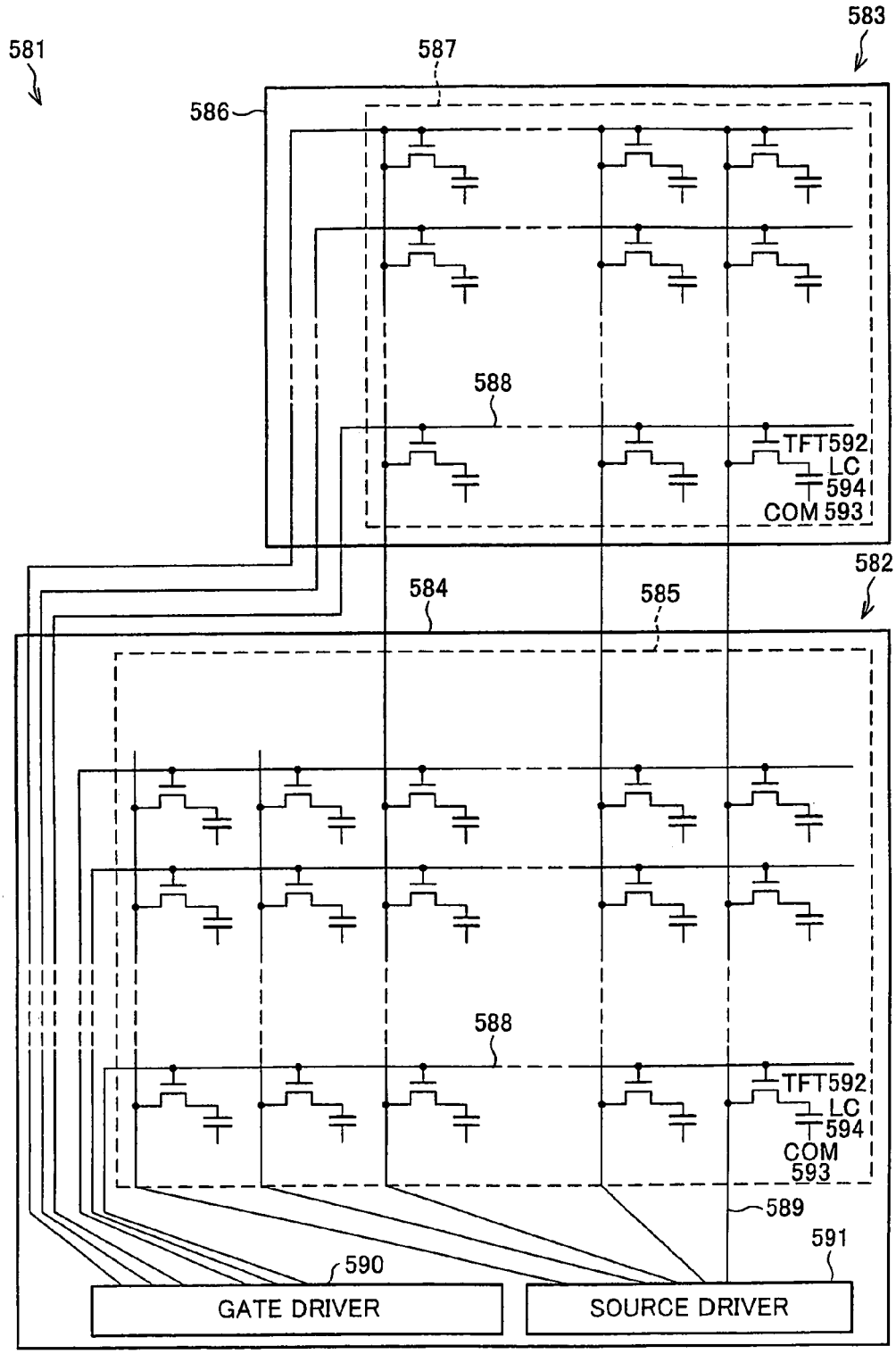
FIG. 11 is a circuit diagram showing a conventional twin-panel display device.

In the above embodiment, the switching TFT 17 to be connected to a capacitive load may be arranged as shown in FIG. 10, that is, the switching TFT 17 is formed of an n-channel MOSFET 301, a p-channel MOSFET 302, and an inverter 303. This CMOS arrangement is advantageous in that a voltage level can be stably controlled in terms of capacity, as well as in that more accurate switching operation is possible as compared with a one-channel arrangement. However, if considering only switching operation, the switching TFT 17 constituted of a one-channel switching element is acceptable.

Note that, in the liquid crystal display device 2, the combination of resolution of the sub panel 100 with the main panel 200 can be freely determined according to how many parts the time-sharing drive of the main panel 200 is divided into. In the present embodiment, the time-sharing drive of the main panel 200 is divided into three parts. Therefore, the main panel 200 can perform display with resolution up to three times higher than the sub panel 100.

Further, in the liquid crystal display device 2, the switching TFT 17 of the time-sharing driving section 119 is used both as a switch for driving in a time-sharing manner and a switch for disconnecting the sub panel 100 from the main panel 200. Therefore, as compared with a case where a dedicated switch is provided individually, less number of parts is required, thereby simplifying the arrangement and reducing costs.

Further, in the mobile phone 40, the first liquid crystal panel 10 (sub panel 100) in which the source driver 15 is provided, i.e., the first liquid crystal panel 10 (sub panel 100) provided on an outer surface of the cover section 42 does not necessarily have to be turned off when the cover section 42 is opened. The first liquid crystal panel 10 (sub panel 100) may be always turned on regardless of whether the cover section 42 is opened or closed.

In the above embodiments, the switching TFT 17 is driven by a signal from the source driver 15 or the source driver 115; however, the switching TFT 17 may be driven by another drive circuit.

A display device of the present invention includes first display section, which is provided with a source-signal-line drive circuit, second switching section, and second display section. Each source signal line of the second display section is connected to a corresponding source signal line of the first display section through the second switching section. The second display section shares the source-signal-line drive circuit with the first display section. The second display section is more frequently used for display than the first display section.

Further, a drive method of the display device of the present invention drives a display device having the first display section and the second display section. The drive method of the display device includes the steps of: using the second display section less frequently used for display than the first display section; supplying a display data signal to the source signal lines of the second display section through the source signal lines of the first display section; conductively connecting corresponding source signal lines of the first display section and the second display section when the second display section performs display operation; and conductively disconnecting the corresponding source signal lines when the first display section performs display operation and the second display section stops display operation.

With this arrangement, the second display section can be disconnected from the first display section when the first display section performs display operation and the second display section stops display operation. Accordingly, an electrical load due to connection of the first display section and the second display section can be reduced, thereby lowering electric power consumption.

Further, a display data signal is supplied to a source signal line of the second display section that is used for display less frequently, through a source signal line of the first display section that is used for display more frequently. Therefore, the source signal line of the second display section and the source signal line of the first display section are connected for a short period of time during operation of the display device, thereby further reducing electric power consumption.

The display device may be arranged so that the second display section may have more pixels than the first display section.

Further, the drive method of the display device may be arranged so that the second display section may have more pixels than the first display section.

According to the above arrangement, the first display section has a relatively small number of pixels, i.e., low resolution, and the second display section has a relatively large number of pixels, i.e., high resolution. In such an arrangement, the first display section with a relatively small number of pixels is used for display with more frequently. Therefore, this arrangement is suitable to achieve reduction of electric power consumption.

The display device may be arranged so that the first display section and the second display section are provided in an apparatus whose second hosing is foldable/unfoldable relative to its first housing, and the first display section is provided with its display surface disposed in an outer surface of the first or the second housing in a folded state where the second housing is closed in respect to the first housing, and the second display section is provided with its display surface disposed on an inner surface of the first or the second housing in a folded state.

Further, the drive method of the display device may be arranged so that the first display section and the second display section are provided in an apparatus whose second hosing is foldable/unfoldable relative to its first housing, and the first display section is provided with its display surface disposed in an outer surface of the first or the second housing in a folded state where the second housing is closed in respect to the first housing, and the second display section is provided with its display surface disposed on an inner surface of the first or the second housing in a folded state.

In an apparatus provided with a display device in which the second housing is foldable/unfoldable relative to the first housing, the display device is more frequently used in a folded state where the second housing is closed in respect to the first housing. Therefore, reduction of electric power consumption is achieved by an arrangement in which the first display section is provided with its display surface disposed in an outer surface of the first or the second housing in the folded state where the second housing is closed in respect to the first housing, and the second display section is provided with its display surface disposed on an inner surface of the first or the second housing in the folded state.

The display device may be arranged so that a plurality of source signal lines in the second display section correspond to one source signal line in the first display section, and the display device has a time-sharing drive section for sequentially switching a display data signal of the one source signal line in the first display section in a time-sharing manner so as to supply the display data signal to the plurality of source signal lines, corresponding to the one source signal line, in the second display section.

The drive method of driving the display device may be arranged so that a plurality of source signal lines in the second display section correspond to one signal line in the first display section, and the display device has a time-sharing drive section for sequentially switching a display data signal of the one source signal line in the first display section in a time-sharing manner so as to supply the display data signal to the plurality of source signal lines, corresponding to the one source signal line, in the second display section.

According to the above arrangement, a display data signal can be properly supplied to the second display mean with a large number of pixels through the first display section with a small number of pixels.

The display device may be arranged so that the second switching section is used also as the time-sharing driving section.

Since the above arrangement uses a small number of switching section, it needs less number of sections, thereby simplifying the arrangement and reducing costs.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

A display device of the present invention, having a plurality of display sections, can be used for a stationary or fixed apparatus using an AC power supply exclusively. However, the display device of the present invention is particularly suitable for a portable apparatus, e.g., a mobile phone or a personal digital assistant (PDA) having a plurality of display sections, which portable apparatus is driven by a battery and therefore the major demand thereof is reduction in power consumption.

What is claimed is:

1. A display device, comprising:

a first display section which includes a plurality of gate signal lines; a plurality of source signal lines; first switching sections, each of which is disposed near each of crossings of the gate signal lines and the source signal lines with a control terminal for switching operation connected to the gate signal line; pixel electrodes, each of which is connected to the source signal line through the first switching section, the first display section further including a source-signal-line drive circuit for supplying a display data signal to each of the plurality of source signal lines;

a second switching section; and a second display section which includes the plurality of gate signal lines; the plurality of source signal lines; the first switching sections; and the pixel electrodes, each of the source signal lines of the second display section being connected to a corresponding one of the source signal lines of the first display section through the second switching section, the second display section sharing the source-signal-line drive circuit with the first display section, the second switching section connects the corresponding source signal lines of the first display section to the source signal lines of the second display section and disconnects the corresponding source signal lines of the first display section from the source signal lines of the second display section based a switching control signal, the second display section being used for display less frequently than the first display section.

2. The display device according to claim 1, wherein the second display section has a larger number of pixels than the first display section.

3. The display device according to claim 2, wherein the plurality of source signal lines of the second display section correspond to one source signal line of the first display section, and the display device further comprises a time-sharing drive circuit for sequentially supplying display data signals from the one source signal line of the first display section to corresponding ones of the plurality of source signal lines of the second display section in a time-sharing switching manner.

4. The display device according to claim 3, wherein the second switching section is used also as the time-sharing drive circuit.

5. The display device according to claim 1, wherein the first display section and the second display section are provided in an apparatus in which a second housing is foldable/unfoldable relative to a first housing, and the first display section has a display surface disposed in an outer surface of the first or the second housing when the apparatus is in a folded state where the second housing is closed in respect to the first housing, and the second display section has a display surface disposed in an inner surface of the first or the second housing in said folded state.

6. The display device according to claim 1, wherein the second switching section disconnects the corresponding source signal lines of the first display section from the source signal lines of the second display section based on the switching control signal when the first display section performs display operation and the second display section stops display operation.

7. A drive method of the display device, the display device comprising:

a first display section which includes a plurality of gate signal lines; a plurality of source signal lines; the first switching sections, each of which is disposed near each of crossings of the gate signal lines and the source signal lines with a control terminal for switching operation connected to the gate signal line; and pixel electrodes connected to the source signal line through the first switching section, and a second display section which includes the plurality of gate signal lines; the plurality of source signal lines; the first switching sections; and pixel electrodes, the method comprising the steps of:

supplying a display data signal to the source signal line of the second display section through the source signal line of the first display section;

conducting corresponding ones of the source signal lines of the first display section and the source signal lines of the second display section when the second display section performs display operation; and disconnecting the corresponding ones of the source signal lines of the first display section from the source signal lines of the second display section when the first display section performs display operation and the second display section stops display operation, wherein:

the second display section is used for display less frequently than the first display section.

8. The drive method of a display device according to claim 7, wherein the second display section has a larger number of pixels than the first display section.

9. The method of driving a display device according to claim 8, wherein the plurality of source signal lines of the second display section correspond to one source signal line of the first display section, and the method further comprises the step of sequentially supplying display data signals from the one source signal line of the first display section to corresponding ones of the plurality of source signal lines of the second display section in a time-sharing switching manner.

10. The drive method of a display device according to claim 7, wherein the first display section and the second display section are provided in an apparatus in which a second housing is foldable/unfoldable relative to a first housing, and the first display section has a display surface disposed in an outer surface of the first or the second housing when the apparatus is in a folded state where the second housing is closed in respect to the first housing, and the second display section has a display surface disposed in an inner surface of the first or the second housing in said folded state.

11. A drive system for driving a plurality of source signal lines provided in a first display section, and a larger number of source signal lines provided in a second display section, wherein:

the source signal lines of the first display section and the source signal lines of the second display section are connected through a switch section provided therebetween, and the source signal lines of the second display section are driven by a source-signal-line drive circuit, provided in the first display section, which drives the source signal lines of the first display section, the switch section connects corresponding source signal lines of the first display section to the source signal lines of the second display section and disconnects the corresponding source signal lines of the first display section from the source signal lines of the second display section based a switching control signal.

12. The drive system according to claim 11, wherein a source signal line of the first display section is driven more frequently than a source signal line of the second display section.

* * * * *